US006527100B2

(12) United States Patent
Ballestrazzi et al.

(10) Patent No.: US 6,527,100 B2
(45) Date of Patent: Mar. 4, 2003

(54) TURNING DEVICE FOR GRAPHIC PUBLISHING PRODUCTS IN A CONVEYOR LINE AND/OR PACKAGING MACHINE

(75) Inventors: Aris Ballestrazzi, Savignano Sul Panaro (IT); Lamberto Tassi, Savignano Sul Panaro (IT)

(73) Assignee: SITMA S.p.A., Spilamberto (IT)

( * ) Notice: Subject to any disclaimer, the term of this patent is extended or adjusted under 35 U.S.C. 154(b) by 50 days.

(21) Appl. No.: 09/769,305

(22) Filed: Jan. 26, 2001

(65) Prior Publication Data

US 2001/0010282 A1 Aug. 2, 2001

(30) Foreign Application Priority Data

Jan. 31, 2000 (IT) ..... MI00A0138

(51) Int. Cl.[7] ..... B65G 47/24

(52) U.S. Cl. ..... 198/373; 198/403; 198/404; 414/759; 414/773

(58) Field of Search ..... 198/374, 403, 198/404; 414/765, 759, 773; 270/58.07, 58.29

(56) References Cited

U.S. PATENT DOCUMENTS 3,280,995 A * 10/1966 Barkley ..... 214/301
3,520,395 A * 7/1970 Jablonski, Jr. et al. ..... 198/35
3,825,247 A * 7/1974 Fernandez-Rana et al. ... 270/58
4,050,574 A * 9/1977 Chenevard et al. ..... 198/458
4,569,620 A * 2/1986 Lynch ..... 198/405
4,669,968 A * 6/1987 Milholen ..... 198/422
4,798,278 A * 1/1989 Cornacchia ..... 198/404
4,907,686 A * 3/1990 Cotic ..... 198/399
4,977,997 A * 12/1990 Takigawa et al. ..... 198/404
5,620,081 A * 4/1997 Kivits ..... 198/404
5,971,697 A 10/1999 Ballestrazzi et al.
5,988,352 A 11/1999 Ballestrazzi et al.
6,032,781 A 3/2000 Ballestrazzi et al.
6,048,165 A * 4/2000 Karhumaki ..... 414/788.2
6,409,008 B1 * 6/2002 Newsome ..... 198/403

* cited by examiner

*Primary Examiner*—Douglas Hess
(74) *Attorney, Agent, or Firm*—Oblon, Spivak, McClelland, Maier & Neustadt, P.C.

(57) ABSTRACT

A turning device for graphic publishing products in a conveyor line and/or packaging machine that can be combined with a push conveyor (14) for the advancement of products (11), spaced out one after the other, including a supporting member (16) bearing in sequence a first conveyor unit (17) to pickup at least one of the products (11) off the conveyor line, a grasping and turnover unit (18) of at least one of the products (11), a second conveyor unit (19) to deposit at least one of the products (11), turned upside down on the conveyor line, the conveyor units (17, 19) being operated to advance in phase with the push conveyor (14) and being movable between a working position and a disengaged position with the conveyor line.

9 Claims, 2 Drawing Sheets

Figure 1:
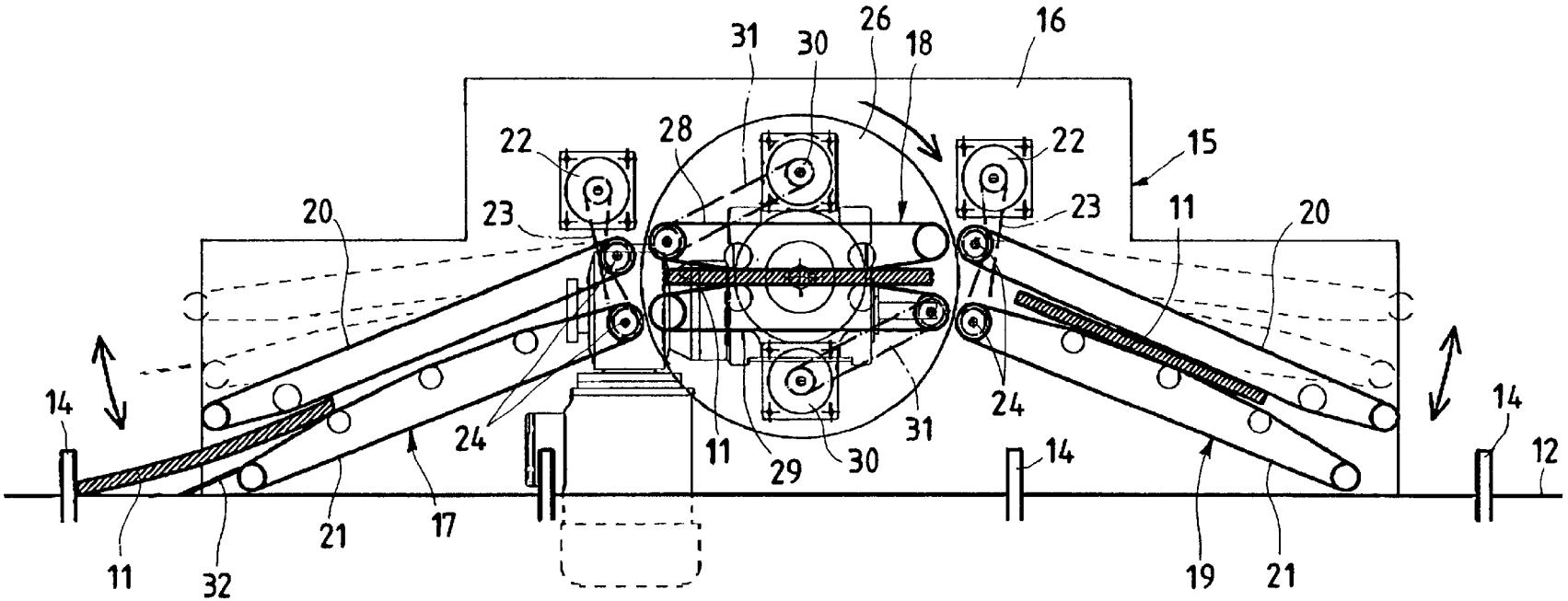

TURNING DEVICE FOR GRAPHIC PUBLISHING PRODUCTS IN A CONVEYOR LINE AND/OR PACKAGING MACHINE

The present invention refers to a turning device for graphic publishing products in a conveyor line and/or packaging machine that can be combined with a push conveyor for the advancement of products spaced out one after the other.

In packaging machines, or in conveyor lines of flat graphic and publishing products, namely sheets, signatures, magazines, brochures etc. made to advance one after the other, it must be possible to rotate and/or turnover these products, one at a time, to have both sides of the product being transported facing upwards at successive times.

This position is particularly useful when one or more additional sheets, or similar, generally known as inserts, must be combined with the graphic publishing product on both sides of the same product.

In fact, it is important that the inserts occupy a particular position or side of the product, depending on their importance and the desired type of impact on those buying the end product, with its relative inserts.

Various solutions are currently used to achieve this position.

An initial solution is that of adding a separate device at the end of the packaging machine or conveyor line, and placed in line with it, which turns the product over. Hence the turned product is then sent towards a second packaging machine or conveyor line which also adds each additional insert on a different side of the product before passing on to the packaging machine unit, which wraps it in a film of plastic material or a suitable paper cover.

This separate machine does not satisfy the need to put the required number of inserts on different sides, in addition to a basic product, and at high working speed. Furthermore, it involves the use of several lines and devices, which ties up considerable resources resulting in extra costs.

An additional solution put forward is that which is the subject of the European patent EP 819.637 of the same applicant, to which reference is made to better understand the need for such a device in a conveyor line and/or packaging machine.

Such a solution is accomplished with a grasping, rotation, 180° turnover and belt guide unit which however sets the placing of the lengthwise lateral back of the publishing product in an opposite position in the two arrangements assumed before and after turning.

A further example of a solution is that shown in the patent EP 676.344 in which a swivel takes the incoming product in its pockets, turns it over and then releases it.

Such a solution requires specially shaped belts, both in the incoming conveyor line and the outgoing conveyor line from the swivel. Moreover, the swivel blades can hit against the pushers of the conveyor unit and hence the construction and setting up of such a device can prove complicated.

In addition, such a solution does not ensure the stability of the publishing product present in the pocket during rotation, especially when there are several overlapped products together. During rotation, the publishing product may even come out of the pocket, if rotation is at high speed. Hence a low speed is necessary. If there are several overlapped products, these are separated upon exit from the pocket and their feed is incorrect and disrupted on the exit belt.

One object of the present invention is to produce a device which solves the technical problems encountered previously.

In fact, the object of the present invention is to have a turning device which allows the fastest possible sheet insert feed into different sides of the graphic publishing product, within the same conveyor line or packaging machine, without having a different arrangement of the graphic product in relation to its lengthwise lateral back.

A further object of the present invention is to correctly accomplish this feed on the second side, even if a certain number of inserts have previously been fed into an initial product side.

Another object is to avoid any possible separation of the product and/or publishing products during the various loading, turning and unloading stages on the turning device.

These objects, according to the present invention, are reached by producing a turning device as detailed below.

Figure 2:
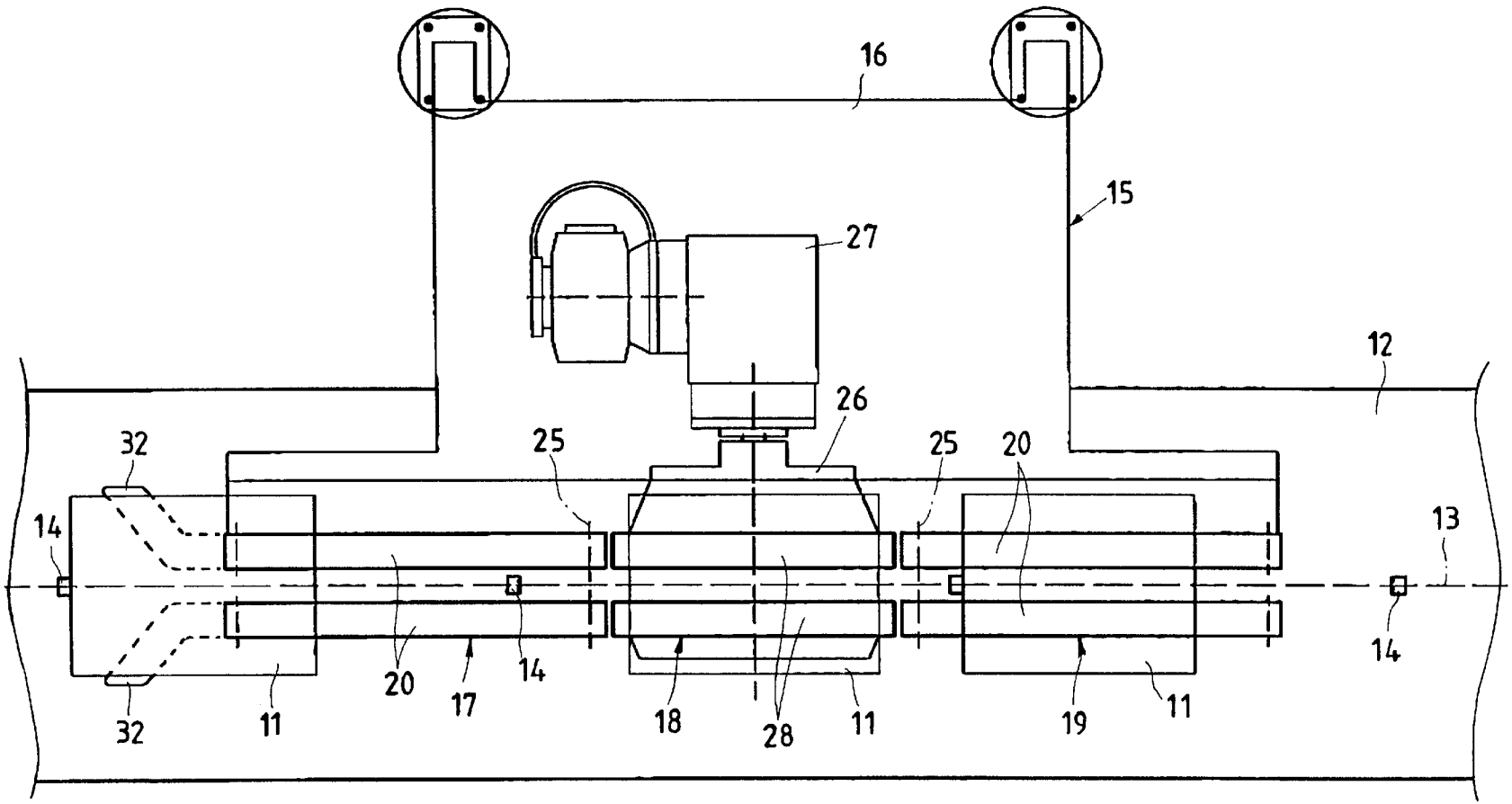

The characteristics and advantages of a turning device, according to the present invention, will be made clearer from the enclosed designs, supplied simply as explanatory, non-limiting examples, in which:

FIG. 1 shows a side elevation outline view of a device, according to the present invention, laterally combined with a push conveyor, FIG. 2 shows an aerial plan view of FIG. 1.

With reference to FIGS. 1 and 2, it is noted how, in rough outline, a conveyor line is shown for flat graphic and publishing products, namely double-sided sheets, signatures, magazines, brochures etc. which are denoted in outline by 11.

As said, additional sheet parts, generally known as inserts, must then be combined to these graphic publishing products 11, on one or both opposing sides, which are usually supplied by feeders, not shown, normally set alongside the conveyor line or packaging machine.

The conveyor line includes a support surface and guide 12, equipped with a central channel, denoted by axis 13, within which run a number of pushers 14, for example pulled by an underlying control unit (not shown).

Each pusher 14 causes the advancement of a graphic publishing product 11 towards a device, according to the present invention, denoted as a whole by 15.

This turning device 15 of a product 11 must therefore turn or invert the advanced products 11 keeping their running direction and the step set by the conveyor line unaltered, without changing the lengthwise direction of the lateral back, also lengthwise, of the publishing product 11.

For this purpose, the device 15 includes a base 16 to support it and make it combinable with the conveyor line by positioning it above the support surface and guide 12.

The base 16 bears in sequence a first conveyor unit 17 to pickup at least one of the cited products 11 off the conveyor line, advanced by the relative pusher 14. Then, a grasping and turnover unit is envisaged denoted, as a whole, by 18 for at least one of the graphic publishing products 11, able to receive this product from the first conveyor unit 17 and turn it.

Finally, a second conveyor unit 19 receives the turned product 11 and deposits it upside down on the underlying conveyor line, in phase, so that it is taken away by the relative pusher 14 which advances on the surface 12.

First of all, it must be noted that the two conveyor units 17 and 19 are made to advance in phase with the motorization of pushers 14.

The first pickup conveyor unit 17 of at least one of the cited products 11, includes two facing pairs of ring wrapped upper 20 and lower 21 belts, spaced out from each other so as to allow the passage of the pushers 14 when in a lowered working position. In fact, it must be noted that such a conveyor unit 17 can be moved from a lowered working position, shown in FIG. 1 (by the unbroken line) and a raised position shown by a dotted line, which allows the unrestricted advancement of the single products 11; actuators may be present for raising and lowering, not shown. The belts 20 and 21, are driven by a motor 22 and by a transmission 23, e.g. chain type, which engage on toothed pinions 24, carried by a shared shaft outlined by 25. The two pairs of belts 20 and 21 facing each other, grasp the product 11 on their insides and taking it off the conveyor line, line it up with the subsequent grasping and turnover unit 18. This also occurs due to the presence of lamina deflection guides 32, in line with the lower belt entrance 21, which rest on the guide surface 12.

This grasping and turnover unit 18 includes a table type bearing part 26 which is turned by a connected motor drive 27 as said, to both the first conveyor unit 17 as well as to the second conveyor unit 18. The bearing part 26 also supports two pairs of ring wrapped upper 28 and lower 29 belts, facing each other, spaced out and driven by a motor 30 and relative transmission 31 with pinions. In this way, the passage of the single product 11 is made possible, which is received from the conveyor unit 17, when the same are lined up at the end of the same belts 20 and 21 and when the unit 18 has been turned 180° so as to bring it back into line with the second conveyor unit 19. During rotation of the unit 18 there is the certainty that the product 11 is kept in the correct position, held between the belts 28 and 29, and blocked. Such an arrangement also favours the handling of several overlapped products blocked between the belts during rotation.

Finally, the second conveyor unit 19 is made in a similar way to mirror the first conveyor unit 17, so as to accomodate the turned or inverted product from the grasping and turnover unit 18. This is also raisable like the cited first unit 17.

The operation of a device, according to the invention, which allows the publishing product to be turned in relation to its sides leaving its longitudinal lateral back position unchanged, is fully apparent.

The product 11 is picked up by the first conveyor unit 17 by means of the belts 20, 21 and aligned to the grasping and turnover unit 18. Then it is transferred within the belts 28 and 29 of the grasping and turnover unit 18 which, having received the product 11, blocks it between the stationary belts. The unit 18 is then turned over or rotated 180°, inverting the product 11. Once in this position, the turned product 11 is released and ejected starting the belts 28, 29 and fed within belts 20 and 21 of the second conveyor unit 19. This conveyor unit 19 then puts it on the conveyor line surface 12 and the relative pusher 14 picks it up and makes it advance. This system avoids the problems associated with the previously known turning devices mentioned before.

Besides, a device according to the invention allows its positioning along the conveyor line or packaging machine in the required position, it being independent and movable in parallel to it, even placed to the right or left of the line. Furthermore, the device can be removed from the conveyor line where it operates and placed on another line.

Its positioning on a line does not require any alteration of the line push conveyor, since the original one is kept.

Hence it can be joined to already existing machines.

It is clear that a single control transmission, namely a chain, which correlates their movement, can be used instead of the motor 27 and the two motors 22.

It is also possible, as already mentioned, to disengage such a turning device simply by raising the belts 20 and 21 of the conveyor units 17 and 19 from the guide surface 12, i.e. from the conveyor line.

The presence of such a device combined with a feeder allows the easy and correct positioning of additional inserts above and inside the publishing product, when necessary. The presence of opening devices of the first page allows internal insertion, before and after turning the product. The device allows the arrangement of insert infeeds or feeders where required, as it may be moved to the required position.

Moreover, operation at a greater working speed of the entire line or packaging machine is ensured from the moment when, during turning, the product and/or products are stapled and held by the pair of belts 28, 29.

Then there is a correct and fast re-feed which is ensured by the restarting of belts 28, 29 in addition to correct transportation, due to the pair of belts 20, 21, with fast and positive advancement, without dispersion, also for several overlapped products.

In fact, the belts 20, 21, 28, 29 go at the same speed and hold the product and/or overlapped products in the correct position.

Alternatively, there may be a drive supplied by a central control of the machine or the conveyor line, allowing the complete and constant timing between product advancement, belts of the conveyor units, belts of the grasping and turnover unit, in addition to the movement of its support part.

The present invention device solves the problems of swivel devices shown previously, where there may be instability of the publishing product, both during transportation when resting on just the underlying belt, as well as during turning in the pockets of the freely moving swivel, and during extraction caused by friction between the pocket and the exit belt.

All of which is not present during conveyance and the positively engaged turning of the present invention.

What is claimed is:

1. A turning device for graphic publishing products conveyed by at least one push conveyor comprising:

a supporting member;

a first conveyor unit, including first and second pairs of ring-wrapped upper and lower belts, for picking up from a conveyor line at least one of the products conveyed by one of the at least one push conveyor;

a grasping and turning unit for grasping and turning over the at least one of said products conveyed by the first conveyor unit, and a second conveyor unit, including third and fourth pairs of ring-wrapped upper and lower belts, for depositing on the conveyor line the at least one of said products turned over by the grasping and turning unit, wherein said first and second conveyor units are operated to advance in phase with the at least one push conveyor and are movable between working and disengaged positions, wherein the upper and lower belts are facing each other and spaced out so as to allow the passage of the at least one push conveyor, when said first and second conveyor units are in a lowered working position.

2. A device as in claim 1, wherein said first conveyor unit further comprises lamina deflection guides, wherein said lamina deflection guides line up with an entrance of said lower belts, and wherein said lower belts rest on a guide surface.

3. A device as in claim 1, wherein said pairs of upper and lower belts are driven by a motor and a chain transmission.

4. A device as in claim 1, wherein said grasping and turning unit includes a bearing member, turnable through 180°, aligned with said first and second conveyor units.

5. A device as in claim 4, wherein said grasping and turning unit further comprises fifth and sixth upper and lower ring-wrapped belts, facing each other, and spaced out and set to turn, and wherein said grasping and turning unit is aligned with said first and second conveyor units.

6. A device as in claim 5, wherein said fifth and sixth upper and lower belts of said grasping and turning unit are kept blocked during rotation of the grasping and turning unit.

7. A device as in claim 1, wherein said grasping and turning unit further comprises fifth and sixth upper and lower ring-wrapped belts, facing each other, spaced out and set to turn, and wherein said grasping and turning unit is aligned with said first and second conveyor units.

8. A device as in claim 4, wherein said fifth and sixth upper and lower belts of said grasping and turning unit are kept blocked during rotation of the grasping and turning unit.

9. A method for turning graphic publishing products comprising:

picking up off a conveyor surface at least one product by a first conveyor unit;

receiving said at least one product in a grasping and turning unit;

turning the grasping and turning unit 180° while belts of the grasping and turning units are blocked;

disengaging at least one product from said grasping and turning unit and feeding the at least one product into a second conveyor unit; and releasing the product from the second conveyor unit onto said conveyor surface.

* * * * *

UNITED STATES PATENT AND TRADEMARK OFFICE

CERTIFICATE OF CORRECTION

PATENT NO. : 6,527,100 B2
DATED : March 4, 2003
INVENTOR(S) : Ballestrazzi et al.

It is certified that error appears in the above-identified patent and that said Letters Patent is hereby corrected as shown below:

Title page,
Item [30], Foreign Application Priority Data should read:

-- [30] Foreign Application Priority Data

Jan. 31, 2000 (IT) …….. MI2000A 000138 --

Signed and Sealed this

Twenty-second Day of July, 2003

JAMES E. ROGAN
*Director of the United States Patent and Trademark Office*